US008961200B2

(12) United States Patent
Okuyama et al.

(10) Patent No.: US 8,961,200 B2
(45) Date of Patent: Feb. 24, 2015

(54) CONNECTOR AND SOLDER SHEET

(75) Inventors: Takeshi Okuyama, Tokyo (JP); Tadashi Kumamoto, Tokyo (JP); Kazuhiro Mizukami, Tokyo (JP); Toshihiro Kusagaya, Tokyo (JP)

(73) Assignee: Fujitsu Component Limited, Tokyo (JP)

( * ) Notice: Subject to any disclaimer, the term of this patent is extended or adjusted under 35 U.S.C. 154(b) by 17 days.

(21) Appl. No.: 13/326,485

(22) Filed: Dec. 15, 2011

(65) Prior Publication Data

US 2012/0164856 A1 Jun. 28, 2012

(30) Foreign Application Priority Data

Dec. 28, 2010 (JP) ..... 2010-294269

(51) Int. Cl.
*H01R 12/00* (2006.01)
*H01R 43/02* (2006.01)
*H01R 12/70* (2011.01)

(52) U.S. Cl.
CPC ..... *H01R 43/0235* (2013.01); *H01R 12/707* (2013.01)
USPC ..... 439/83; 439/657

(58) Field of Classification Search
USPC ..... 439/83, 567
See application file for complete search history.

(56) References Cited

U.S. PATENT DOCUMENTS

| | | | | |
|---|---|---|---|---|
| 4,001,490 | A * | 1/1977 | Lynch | 174/88 R |
| 4,072,401 | A * | 2/1978 | Instone | 439/571 |
| 4,365,856 | A * | 12/1982 | Yaegashi et al. | 439/497 |
| 4,648,681 | A * | 3/1987 | Pass et al. | 439/620.11 |
| 4,872,846 | A * | 10/1989 | Clark | 439/83 |
| 6,116,923 | A * | 9/2000 | Szu | 439/83 |
| 6,716,060 | B2 * | 4/2004 | Gollhofer et al. | 439/567 |
| 8,192,208 | B2 * | 6/2012 | Tamura et al. | 439/83 |
| 2003/0040218 | A1 * | 2/2003 | Gollhofer et al. | 439/567 |
| 2007/0292708 | A1 * | 12/2007 | Pereira | 428/594 |
| 2012/0164856 | A1 * | 6/2012 | Okuyama et al. | 439/83 |

FOREIGN PATENT DOCUMENTS

| | | |
|---|---|---|
| JP | H05-114448 | 5/1993 |
| JP | H05-084487 U | 11/1993 |
| JP | 2010-129664 | 6/2010 |

* cited by examiner

*Primary Examiner* — James Harvey
(74) *Attorney, Agent, or Firm* — IPUSA, PLLC

(57) ABSTRACT

A connector includes a lead part configured to be connected to a board; and a solder sheet having a plate shape. The solder sheet is engaged with and fixed to the lead part with the lead part passing through a hole in the solder sheet. At least one of the lead part and the solder sheet has a structure configured to prevent the solder sheet from coming off the lead part.

4 Claims, 12 Drawing Sheets

CONNECTOR AND SOLDER SHEET

CROSS-REFERENCE TO RELATED APPLICATION

The present application is based upon and claims the benefit of priority of Japanese Patent Application No. 2010-294269, filed on Dec. 28, 2010, the entire contents of which are incorporated herein by reference.

BACKGROUND OF THE INVENTION

1. Field of the Invention

The present invention relates to a connector configured to be mounted on a board by having lead parts soldered to electrodes on the board side, and to a solder sheet used for the soldering.

2. Description of the Related Art

Conventionally, in mounting a connector on a board, lead parts of the connector are soldered to electrodes provided in or on the board, such as through hole electrodes or pad electrodes.

There are various soldering techniques, of which a technique called reflow soldering is widely used. In reflow soldering, first, a mask, in which holes corresponding to spots where soldering is necessary on the board are formed, is placed on the board. Next, the mask is removed after application of solder paste (solder cream). Thereafter, reflow heating is performed with mounting components such as a connector and capacitors placed at predetermined positions. Thereby, soldering is completed. According to reflow soldering, stationary solder cream is heated after its application. Therefore, reflow soldering has the advantage of requiring no technical skills and accordingly being less likely to cause poor soldering.

Japanese Laid-Open Patent Application No. 2010-129664 describes a method of manufacturing an electronic device, which method includes substantially the same process as the above-described process related to reflow soldering. According to this method of manufacturing an electronic device, soldering is performed using a lead-free solder alloy containing Bi, which has high joining reliability.

SUMMARY OF THE INVENTION

According to an aspect of the present invention, a connector includes a lead part configured to be connected to a board; and a solder sheet having a plate shape, wherein the solder sheet is engaged with and fixed to the lead part with the lead part passing through a hole in the solder sheet, and at least one of the lead part and the solder sheet has a structure configured to prevent the solder sheet from coming off the lead part.

According to an aspect of the present invention, a solder sheet having a plate shape is configured to be attached to a lead part of a connector through a hole in the solder sheet.

The object and advantages of the embodiments will be realized and attained by means of the elements and combinations particularly pointed out in the claims.

It is to be understood that both the foregoing general description and the following detailed description are exemplary and explanatory and not restrictive of the invention as claimed.

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF THE PREFERRED EMBODIMENTS

In recent years, some boards on which a connector is to be mounted have become greater in thickness than before, and electrodes tend to be arranged on the board with a narrower pitch (at reduced intervals). Therefore, it may not be possible to supply individual electrodes (through holes in particular) on the board with a sufficient amount of solder.

Further, it is troublesome to place a mask on the board and apply solder paste if the board is large in size or has a complicated structure.

According to an aspect of the invention, it is possible to provide a sufficient amount of solder where required and to reduce the operational load of soldering in soldering a connector to a board.

According to an aspect of the invention, it is possible to attach a solder sheet to a connector without the solder sheet coming off the connector.

According to an aspect of the present invention, a connector and a solder sheet are provided that make it possible to supply a sufficient amount of solder where required and to reduce the operational load of soldering when the connector is soldered to a board.

A description is given below, with reference to the accompanying drawings, of embodiments of the present invention.

[a] First Embodiment

A description is given, with reference to drawings, of a connector 1 according to a first embodiment of the present invention.

Figure 1:
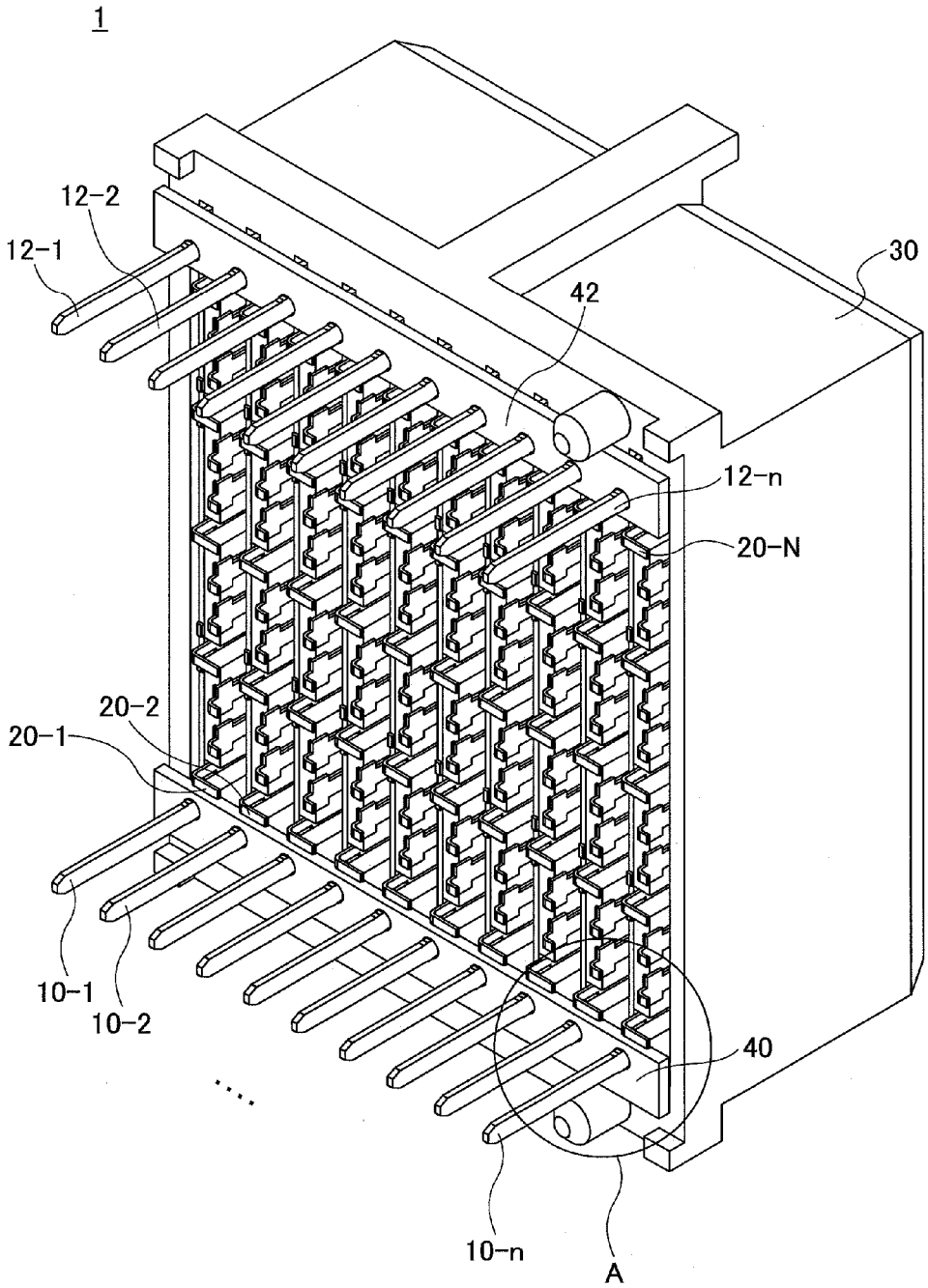
FIG. 1 is a perspective view of a connector according to a first embodiment of the present invention, illustrating an exterior configuration of the connector.

FIG. 1 is a perspective view of the connector 1, illustrating an exterior configuration of the connector 1. As graphically illustrated in FIG. 1, the connector 1 includes multiple leads 10-1, 10-2, . . . 10-n and multiple leads 12-1, 12-2, . . . 12-n to be inserted into (through) and connected to through holes provided in a board (not graphically illustrated); multiple leads 20-1, 20-2, . . . 20-N to be surface-mounted on pads provided on the board; and a housing 30 (where n and N are integers greater than or equal to two). Further, a solder sheet 40 and a solder sheet 42 are attached the leads 10-1, 10-2, . . . 10-n and the leads 12-1, 12-2, . . . 12-n, respectively.

There are multiple projecting contacts (not graphically illustrated) connected to the leads 10-1, 10-2, . . . 10-n, the leads 12-1, 12-2, . . . 12-n, and leads 20-1, 20-2, . . . 20-N on the rear side of the connector 1 of FIG. 1. The leads 10-1, 10-2, . . . 10-n and the leads 12-1, 12-2, . . . 12-n are, for example, connected to ground terminals of the board via through holes, which may be plated, for example, and the leads 20-1, 20-2, . . . 20-N are connected to ground terminals or signal terminals of the board via pads. This allows signals to be transmitted and received and a ground electric potential to be shared between an apparatus to be fit to the connector 1 and the board. Connecting some leads to through holes in this manner facilitates the positioning of the board and the connector 1 in joining the board and the connector 1.

Figure 2:
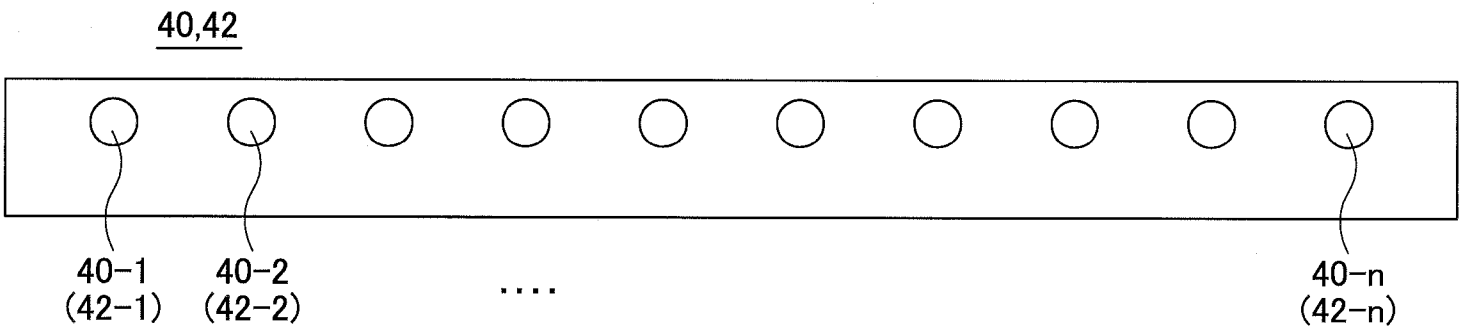
FIG. 2 is a diagram illustrating a shape of solder sheets according to the first embodiment of the present invention.

FIG. 2 is a diagram illustrating a shape of the solder sheets 40 and 42. The solder sheets 40 and 42 are, for example, lead-free solder formed into a plate shape. Multiple circular holes 40-1, 40-2, . . . 40-n and multiple circular holes 42-1, 42-2, . . . 42-n are formed in the solder sheet 40 and the solder sheet 42, respectively. The solder sheets 40 and 42 are so adjusted in rigidity as to be elastically deformable to some degree.

Figure 3:
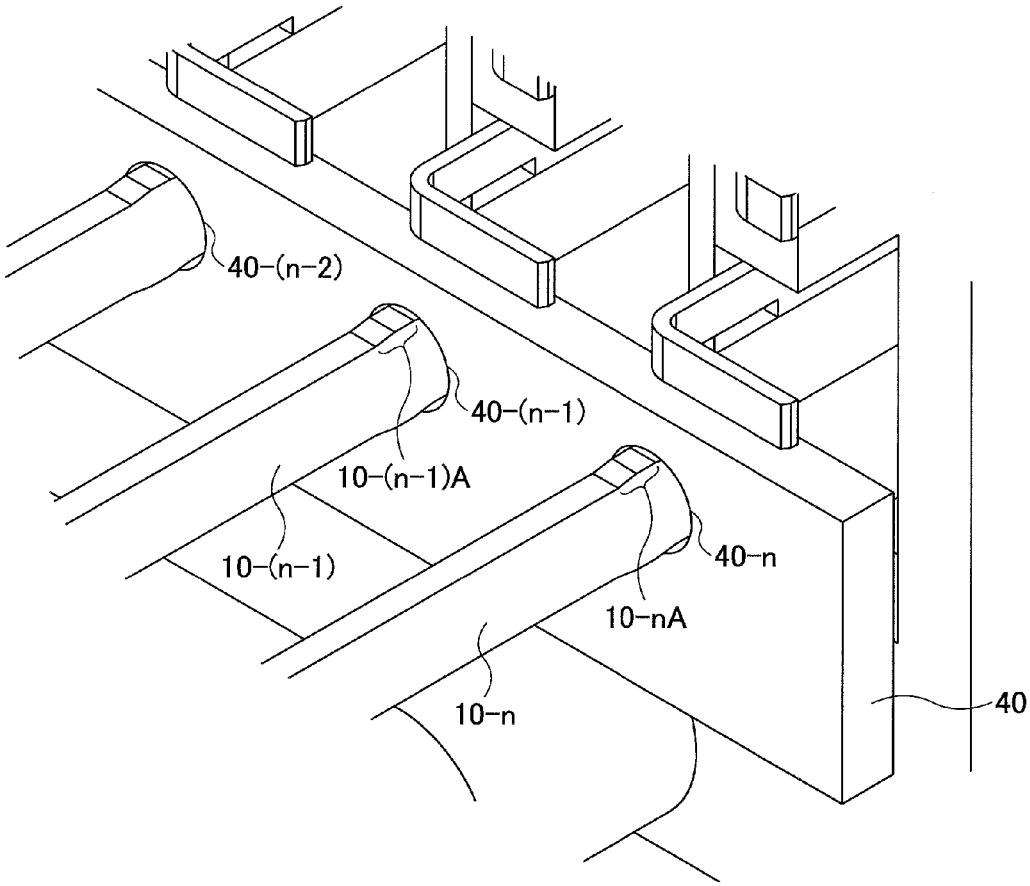
FIG. 3 is an enlarged view of a circled portion indicated by A in FIG. 1 according to the first embodiment of the present invention.

FIG. 3 is an enlarged view of the circled portion indicated by A in FIG. 1. As illustrated in FIG. 3, projecting portions 10-nA, 10-(n−1)A . . . are formed in the leads 10-n, 10-(n−1)A . . . , respectively. The same applies to the leads 12-1, 12-2, . . . 12-n.

Here, a description is given of the lead 10-n by way of example. According to the connector 1 of this embodiment, after the lead 10-n passes through the hole 40-n of the solder sheet 40, the projecting portion 10-nA catches the hole 40-n. This structure prevents the solder sheet 40 from coming off (being separated from) the leads 10-1, 10-2, . . . 10-n, that is, the connector 1.

A description is given below of a process for mounting the connector 1 on a board according to this embodiment.

Figure 4:
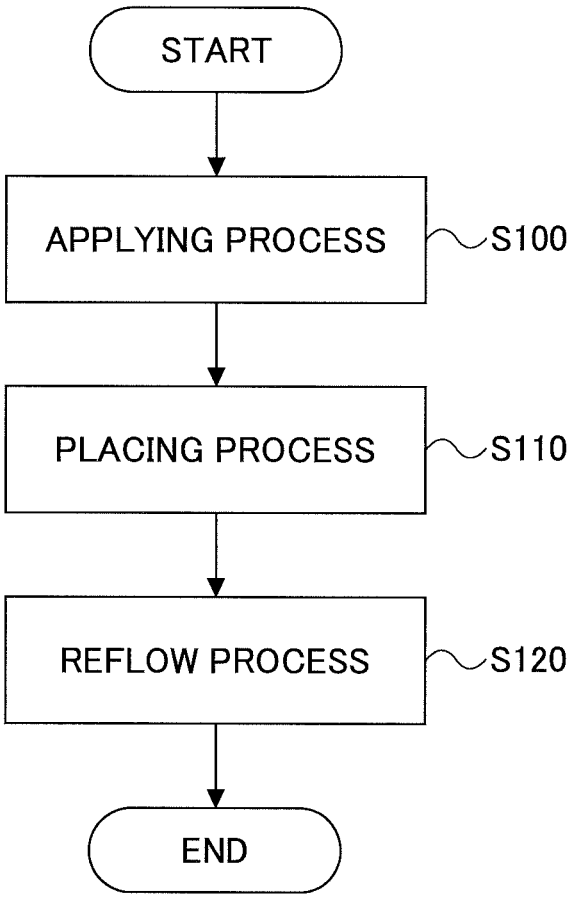
FIG. 4 is a flowchart illustrating a flow of reflow soldering according to the first embodiment of the present invention.

The connector 1 configured as described above is mounted on a board by reflow soldering. A description is given below of individual processes of reflow soldering. FIG. 4 is a flowchart illustrating a flow of reflow soldering according to this embodiment.

First, a board is placed on a placement base serving as a print process base. In step S100 (an applying process), solder paste (solder cream) is applied where through holes and pads are formed on a surface of the board using a metal mask (not graphically illustrated) by printing. The applied solder paste is adjusted to be uniform in thickness using, for example, a knife.

Next, in step S110 (a placing process), the connector 1 is placed on the board, so that the leads 10-1, 10-2, . . . 10-n and the leads 12-1, 12-2, . . . 12-n are inserted into corresponding through holes. The leads 20-1, 20-2, . . . 20-n are so predesigned as to come into contact with corresponding pads in this state.

Then, in step S120 (a reflow process), the board, on which the connector 1 is placed, is placed on a reflow process base, and is subjected to heat treatment in a reflow furnace. At this point, a solvent is removed from the applied solder paste, so that the solder paste is in a molten state. Thereafter, the molten solder paste is cooled and solidified, so that the leads 10-1, 10-2, . . . 10-n and the leads 12-1, 12-2, . . . 12-n are fixed and connected to the corresponding through holes, and leads 20-1, 20-2, . . . 20-n are fixed and connected to the corresponding pads.

In the above-described applying process, the solder paste is adjusted to a uniform thickness, and the solder thickness is not adjusted on an individual electrode basis. A recent trend toward a narrower pitch between electrodes on the board often makes it difficult to make such individual adjustments. Further, a board may be used whose strength is increased by increasing thickness. This has raised concern about insufficient amounts of solder for connections to through holes in particular. If sufficient amounts of solder are not provided in advance for through holes, solder is prevented from reaching the bottom of the through holes, so that leads are fixed and connected to the through holes on only part of the surfaces of the through holes.

On the other hand, it is possible to have solder paste applied in advance with a sufficient thickness so that a sufficient amount of solder may be provided for all electrodes. Usually, however, mounting components other than a connector (such as capacitors) are also provided on and soldered to the board. The pitch is narrower for some of such mounting components than for the connector, so that it is not possible to unlimitedly increase the thickness of the applied solder paste.

Therefore, according to the connector 1 of this embodiment, the solder sheet 40 and the solder sheet 42 are attached in advance to the leads 10-1, 10-2, . . . 10-n and the leads 12-1, 12-2, . . . 12-n, respectively, for which amounts of solder would otherwise be likely to be insufficient at the time of connection (because of establishing connections to through holes). In the above-described reflow process, these solder sheets 40 and 42 melt to flow into corresponding through holes together with the solder paste, and fix and connect the leads 10-1, 10-2, . . . 10-n and the leads 12-1, 12-2, . . . 12-n to the corresponding through holes. Here, a single solder sheet is attached to multiple leads. The molten solder sheet is divided because of surface tension, so that an appropriate amount of solder is separately provided for each lead.

This structure allows sufficient amounts of solder to be provided to the connections of the leads 10-1, 10-2, . . . 10-n and the corresponding through holes and the connections of the leads 12-1, 12-2, . . . 12-n and the corresponding through holes, thus making it possible to improve the strength and the connection reliability. Further, this structure eliminates the necessity of adjusting the thickness of solder on an individual electrode basis, thus making it possible to reduce the operational load of soldering.

According to the above-described connector 1 and the solder sheets 40 and 42 of this embodiment, it is possible to provide a sufficient amount of solder where required and to reduce the operational load of soldering in soldering a connector to a board.

[b] Second Embodiment

A description is given below, with reference to drawings, of a connector 2 according to a second embodiment of the present invention.

Figure 5:
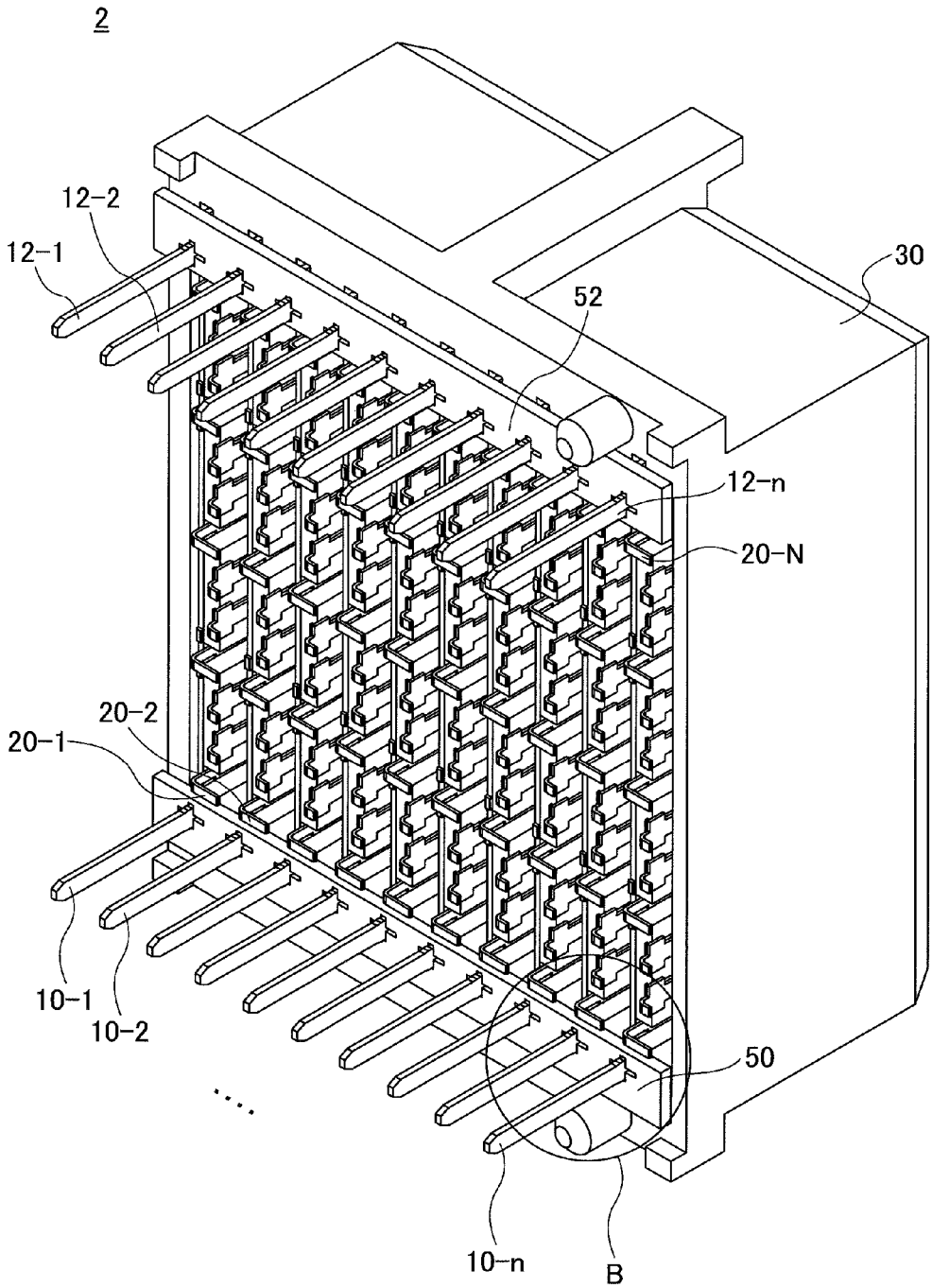
FIG. 5 is a perspective view of a connector according to a second embodiment of the present invention, illustrating an exterior configuration of the connector.

FIG. 5 is a perspective view of the connector 2, illustrating an exterior configuration of the connector 2. As graphically illustrated in FIG. 5, the connector 2 includes the leads 10-1, 10-2, . . . 10-n and the leads 12-1, 12-2, . . . 12-n to be inserted into (through) and connected to through holes provided in a board (not graphically illustrated); the leads 20-1, 20-2, . . . 20-N to be surface-mounted on pads provided on the board; and the housing 30 (where n and N are integers greater than or equal to two). Further, a solder sheet 50 and a solder sheet 52 are attached the leads 10-1, 10-2, . . . 10-n and the leads 12-1, 12-2, . . . 12-n, respectively.

There are multiple projecting contacts (not graphically illustrated) connected to the leads 10-1, 10-2, . . . 10-n, the leads 12-1, 12-2, . . . 12-n, and leads 20-1, 20-2, . . . 20-N on the rear side of the connector 2 of FIG. 5. The leads 10-1, 10-2, . . . 10-n and the leads 12-1, 12-2, . . . 12-n are, for example, connected to ground terminals of the board via through holes, which may be plated, for example, and the leads 20-1, 20-2, . . . 20-N are connected to ground terminals or signal terminals of the board via pads. This allows signals to be transmitted and received and a ground electric potential to be shared between an apparatus to be fit to the connector 2 and the board. Connecting some leads to through holes in this manner facilitates the positioning of the board and the connector 2 in joining the board and the connector 2.

Figure 6:
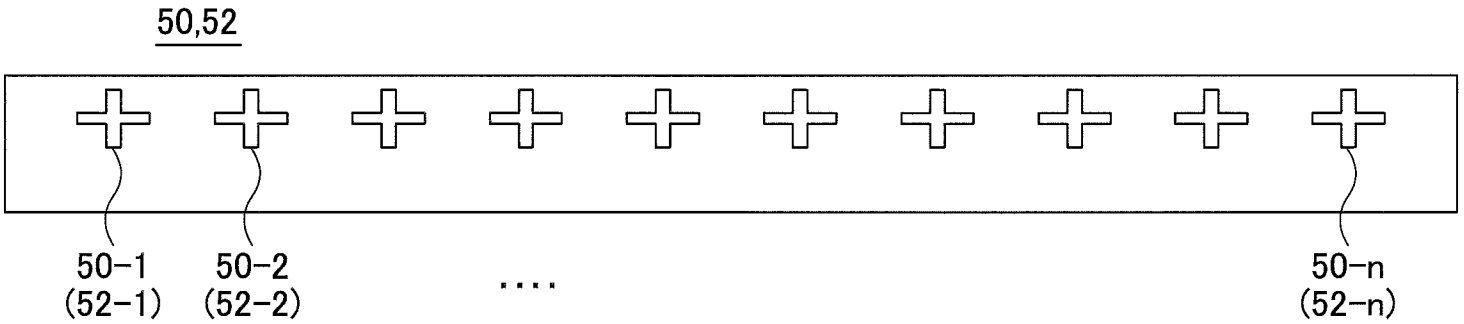
FIG. 6 is a diagram illustrating a shape of solder sheets according to the second embodiment of the present invention.

FIG. 6 is a diagram illustrating a shape of the solder sheets 50 and 52. The solder sheets 50 and 52 are, for example, lead-free solder formed into a plate shape. Multiple holes 50-1, 50-2, . . . 50-n and multiple holes 52-1, 52-2, . . . 52-n are formed in the solder sheet 50 and the solder sheet 52, respectively. These holes 50-1, 50-2, . . . 50-n and 52-1, 52-2, . . . 52-n are cruciform slit-shaped holes. The solder sheets 50 and 52 have rigidity so adjusted as to be elastically deformable to some degree.

Figure 7:
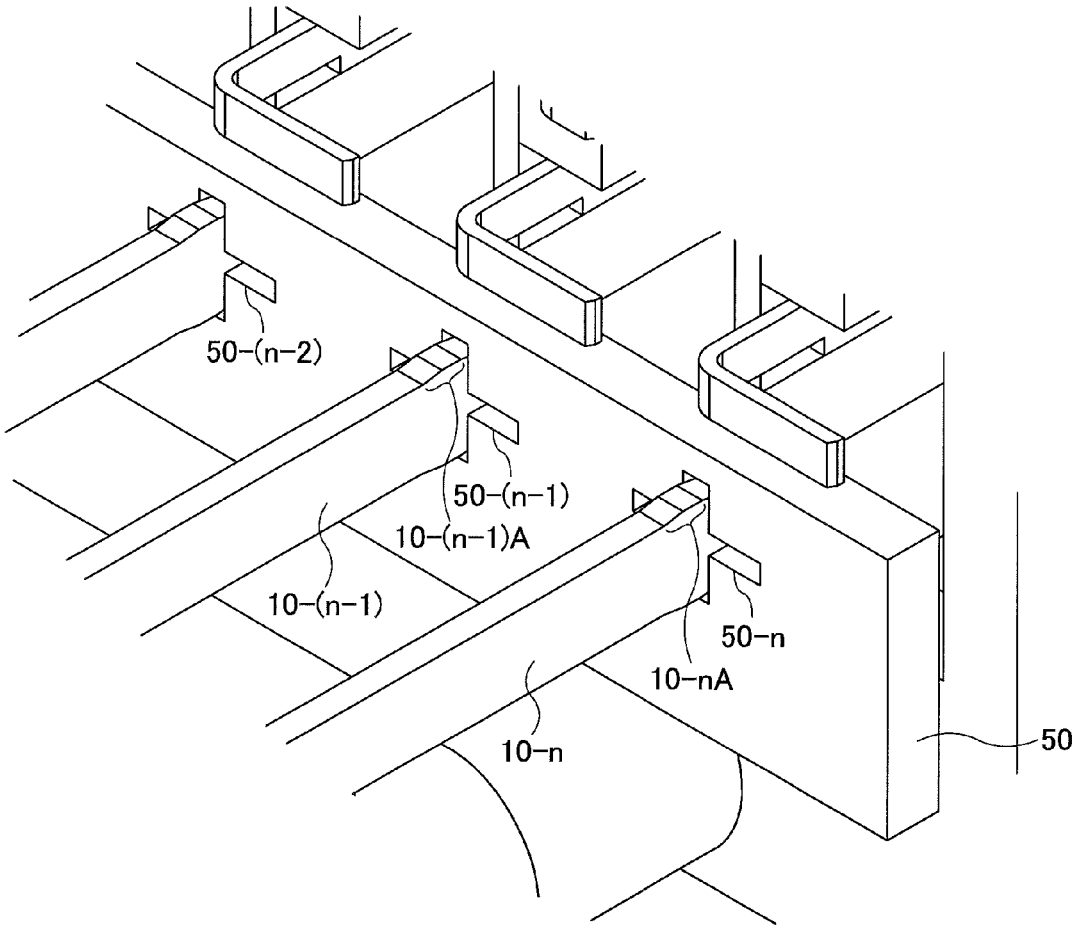
FIG. 7 is an enlarged view of a circled portion indicated by B in FIG. 5 according to the second embodiment of the present invention.

FIG. 7 is an enlarged view of the circled portion indicated by B in FIG. 5. As illustrated in FIG. 7, like in the first embodiment, the projecting portions 10-nA, 10-(n−1)A . . . are formed in the leads 10-n, 10-(n−1)A . . . , respectively. The same applies to the leads 12-1, 12-2, . . . 12-n.

Here, a description is given of the lead 10-n by way of example. According to the connector 2 of this embodiment, after the lead 10-n spreads (with a pressing force) and passes through the hole 50-n of the solder sheet 50, the hole 50-n acts to hold the lead 10-n (between its portions that define the hole 50-n) with its restoring force, and the projecting portion 10-nA catches the hole 50-n. This structure prevents the solder sheet 50 from coming off (being separated from) the leads 10-1, 10-2, . . . 10-n, that is, the connector 2. Accordingly, it is possible to prevent a solder sheet from coming off a connector with more reliability than in the first embodiment.

A description is given below of a process for mounting the connector 2 on a board according to this embodiment.

Like in the first embodiment, the connector 2 configured as described above is mounted on a board by reflow soldering. Reference is made to FIG. 4 for the processes of reflow soldering, and a detailed description thereof is omitted.

According to the connector 2 of this embodiment, the solder sheet 50 and the solder sheet 52 are attached in advance to the leads 10-1, 10-2, . . . 10-n and the leads 12-1, 12-2, . . . 12-n, respectively, for which amounts of solder would otherwise be likely to be insufficient at the time of connection (because of establishing connections to through holes). In the above-described reflow process, these solder sheets 50 and 52 melt to flow into corresponding through holes together with the solder paste, and fix and connect the leads 10-1, 10-2, . . . 10-n and the leads 12-1, 12-2, . . . 12-n to the corresponding through holes. Here, a single solder sheet is attached to multiple leads. The molten solder sheet is divided because of surface tension, so that an appropriate amount of solder is separately provided for each lead.

This structure allows sufficient amounts of solder to be provided to the connections of the leads 10-1, 10-2, . . . 10-n and the corresponding through holes and the connections of the leads 12-1, 12-2, . . . 12-n and the corresponding through holes, thus making it possible to improve the strength and the connection reliability. Further, this structure eliminates the necessity of adjusting the thickness of solder on an individual electrode basis, thus making it possible to reduce the operational load of soldering.

According to the above-described connector 2 and the solder sheets 50 and 52 of this embodiment, it is possible to provide a sufficient amount of solder where required and to reduce the operational load of soldering in soldering a connector to a board.

[c] Third Embodiment

A description is given below, with reference to drawings, of a connector 3 according to a third embodiment of the present invention.

Figure 8:
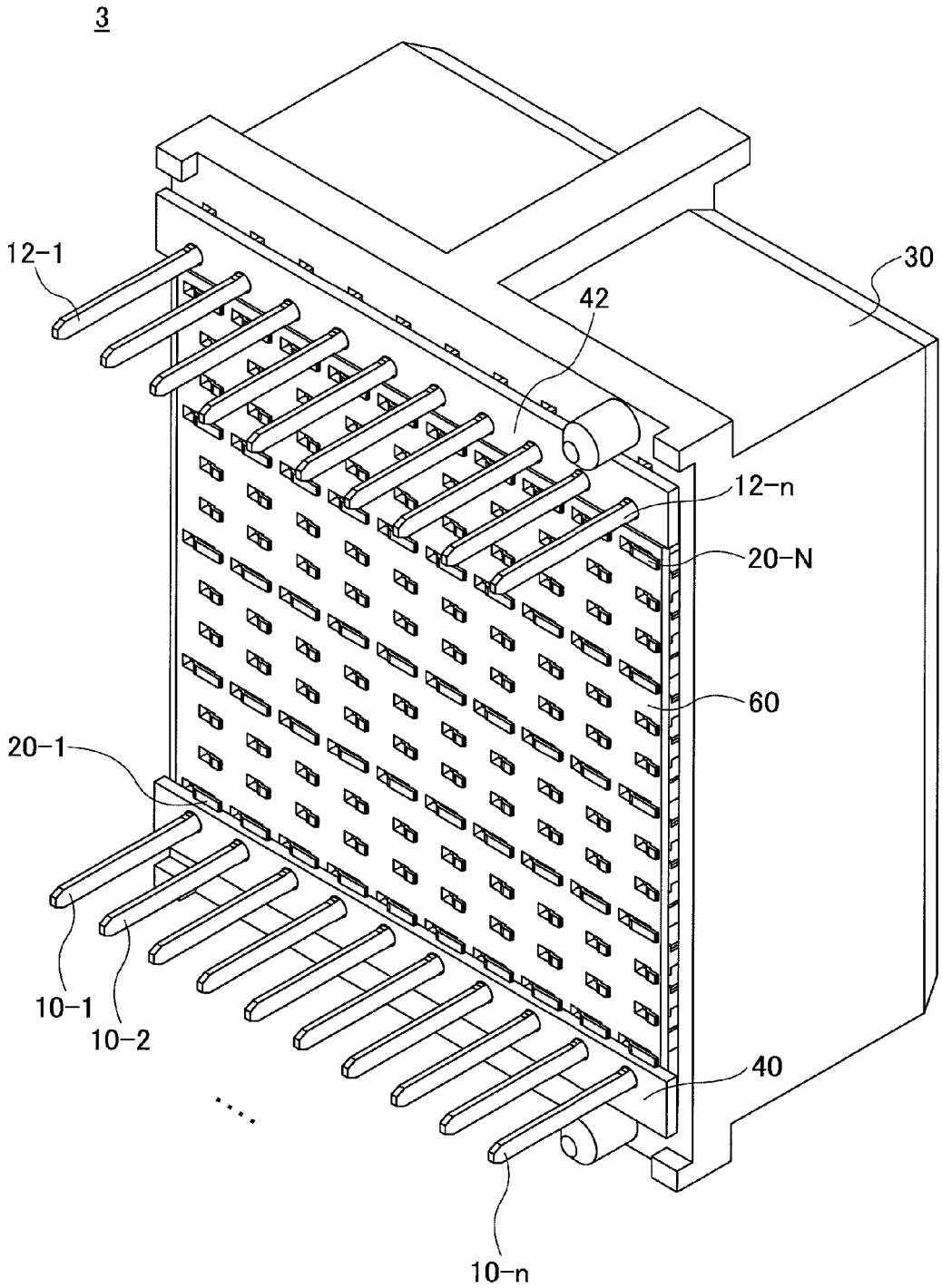
FIG. 8 is a perspective view of a connector according to a third embodiment of the present invention, illustrating an exterior configuration of the connector.
Figure 9:
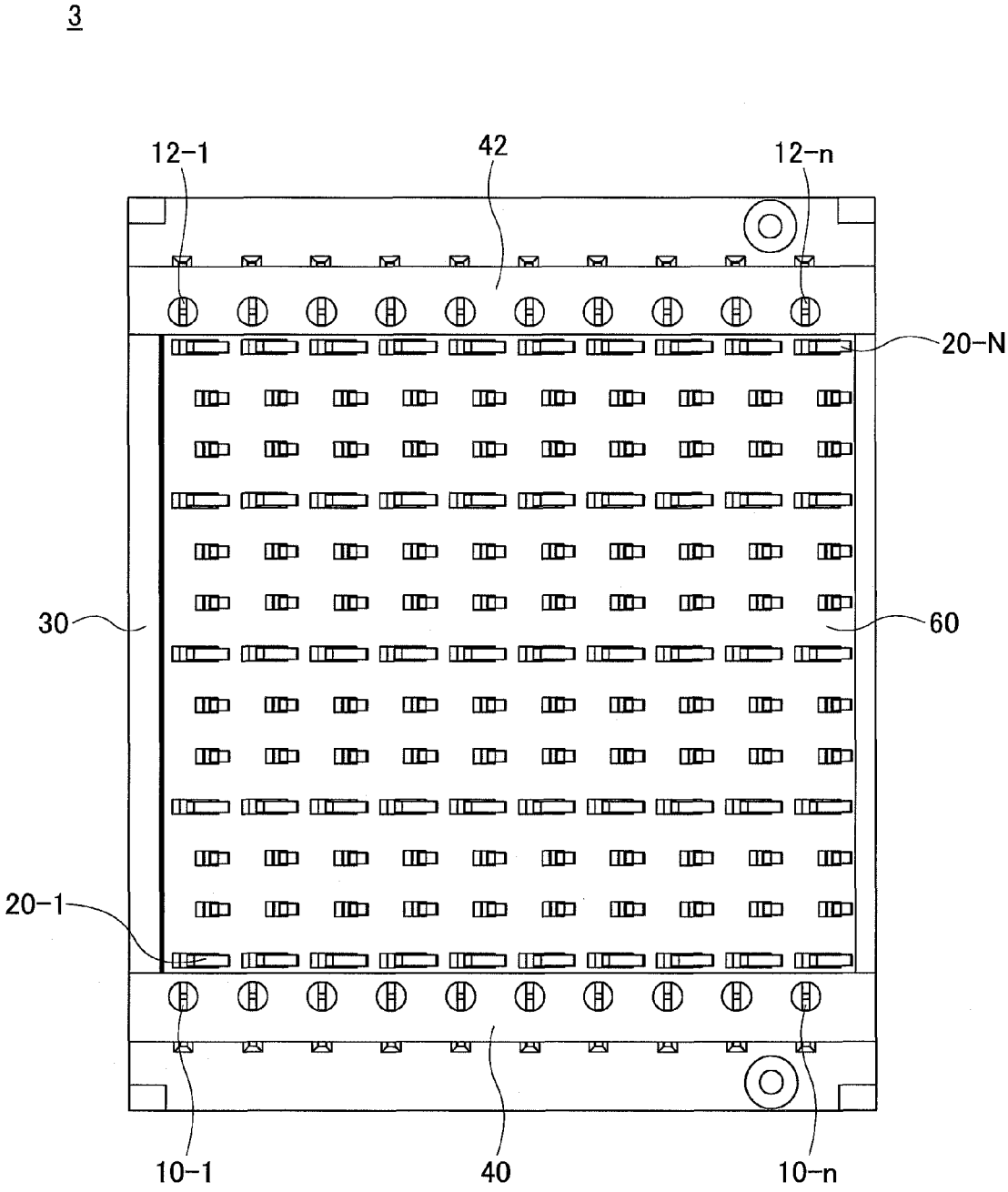
FIG. 9 is a front view of the connector according to the third embodiment of the present invention, illustrating its exterior configuration.

FIG. 8 is a perspective view of the connector 3, illustrating an exterior configuration of the connector 3. FIG. 9 is a front view of the connector 3, illustrating its exterior configuration. In addition to the elements of the connector 1 of the first embodiment or the connector 2 of the second embodiment, the connector 3 further includes a solder sheet 60.

In the illustrated case, the solder sheet 60 is added to the elements of the connector 1 of the first embodiment in the connector 3. That is, the connector 3 includes the leads 10-1, 10-2, . . . 10-n and the leads 12-1, 12-2, . . . 12-n to be inserted into (through) and connected to through holes provided in a board (not graphically illustrated); the leads 20-1, 20-2, . . . 20-N to be surface-mounted on pads provided on the board; and the housing 30 (where n and N are integers greater than or equal to two). Further, the solder sheet 40 and the solder sheet 42 as described in the first embodiment (which may be replaced with the solder sheets 50 and 52 as described in the second embodiment) are attached the leads 10-1, 10-2, . . . 10-n and the leads 12-1, 12-2, . . . 12-n, respectively, and the solder sheet 60 is attached to the leads 20-1, 20-2, . . . 20-N.

There are multiple projecting contacts (not graphically illustrated) connected to the leads 10-1, 10-2, . . . 10-n, the leads 12-1, 12-2, . . . 12-n, and leads 20-1, 20-2, . . . 20-N on the rear side of the connector 3 of FIG. 8 and FIG. 9. The leads 10-1, 10-2, . . . 10-n and the leads 12-1, 12-2, . . . 12-n are, for example, connected to ground terminals of the board via through holes, which may be plated, for example, and the leads 20-1, 20-2, . . . 20-N are connected to ground terminals or signal terminals of the board via pads. This allows signals to be transmitted and received and a ground electric potential to be shared between an apparatus to be fit to the connector 3 and the board. Connecting some leads to through holes in this manner facilitates the positioning of the board and the connector 3 in joining the board and the connector 3.

Figure 10:
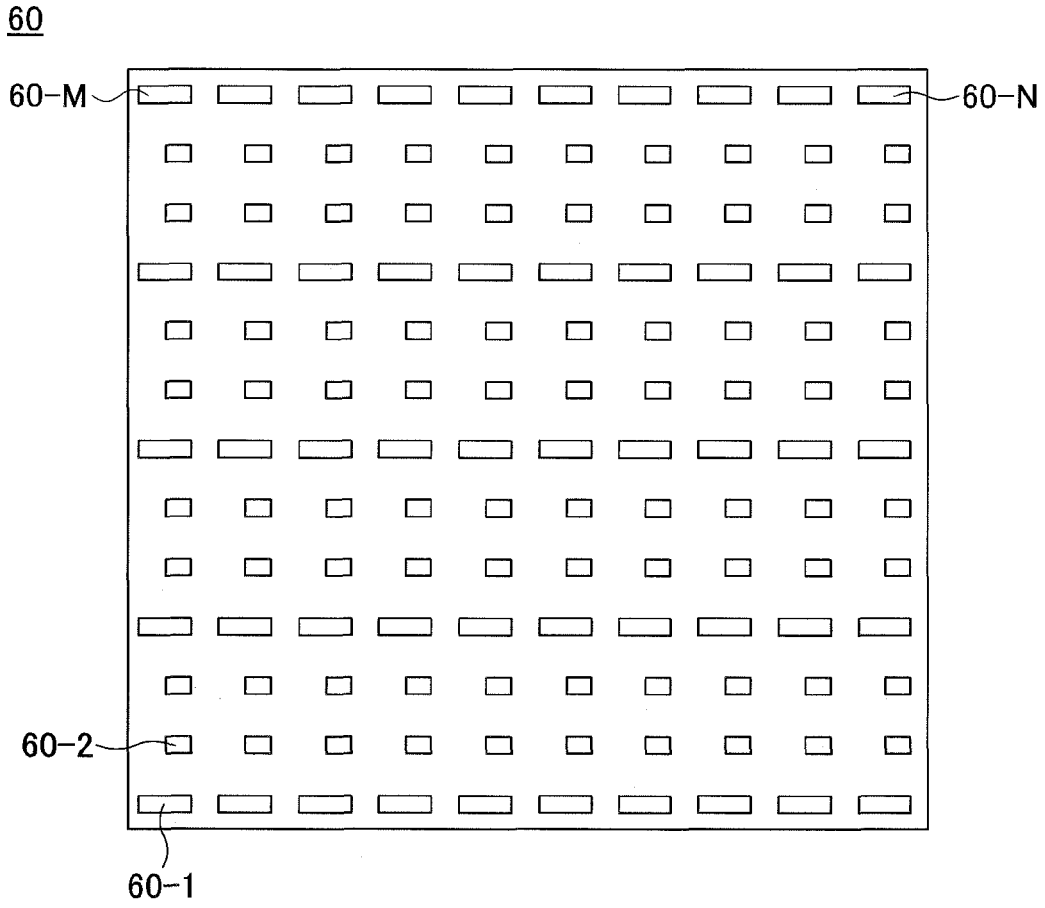
FIG. 10 is a diagram illustrating a shape of a solder sheet according to the third embodiment of the present invention.

FIG. 10 is a diagram illustrating a shape of the solder sheet 60. The solder sheet 60 is, for example, lead-free solder formed into a plate shape. Multiple holes 60-1, 60-2, . . . 60-N are formed in the solder sheet 60. These holes 60-1, 60-2, . . . 60-N are rectangular holes.

Figure 11:
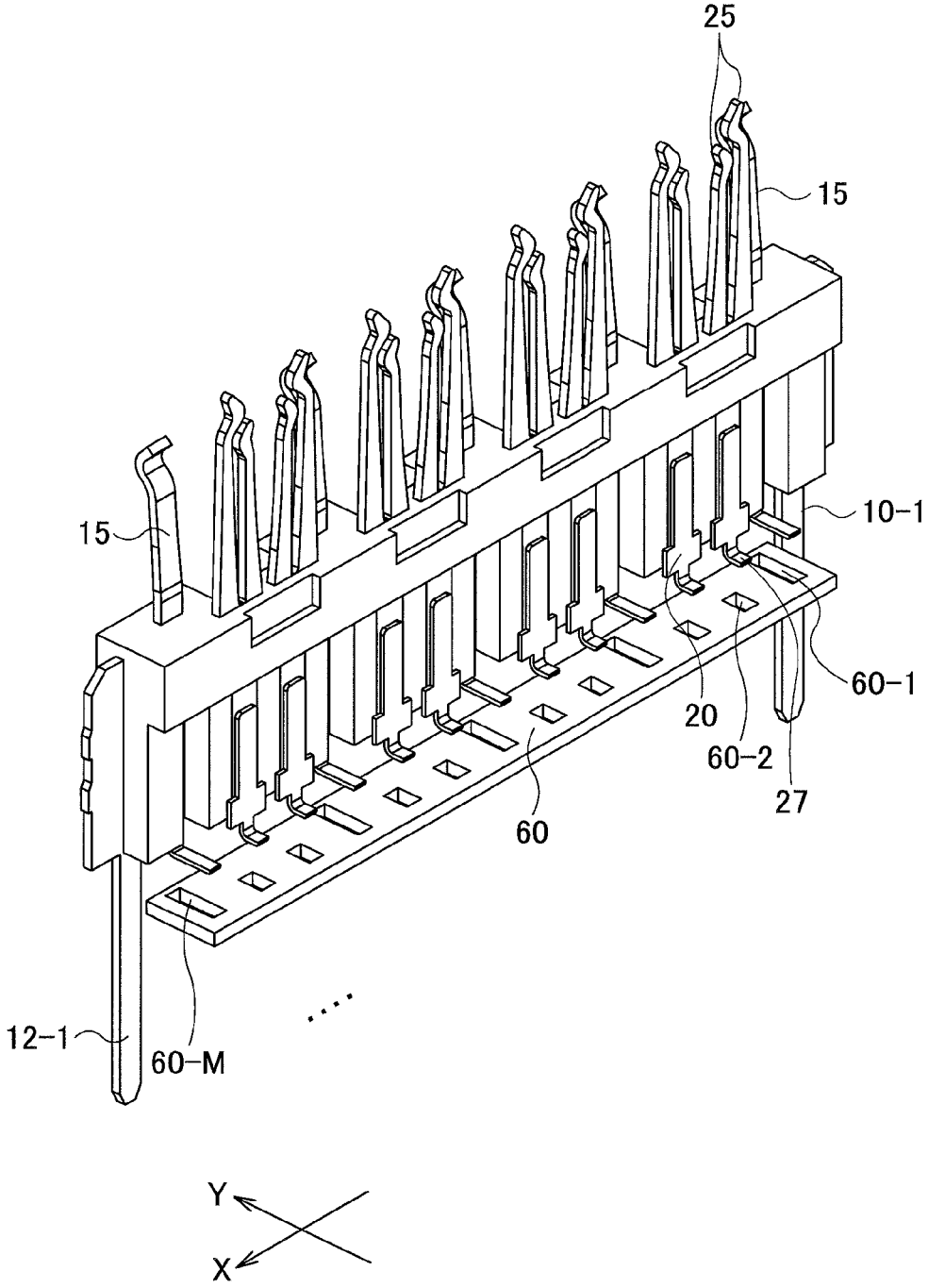
FIG. 11 is an exploded perspective view of part of the connector according to the third embodiment of the present invention, illustrating an array of leads and a corresponding portion of the solder sheet before attachment of the solder sheet.

FIG. 11 is an exploded perspective view of part of the connector 3, illustrating an array of leads and a corresponding portion of the solder sheet 60 before attachment of the solder sheet 60. Here, leads to be connected to ground terminals or signal terminals of the board via pads may be collectively referred to simply as "leads 20" for convenience of description.

As illustrated in FIG. 11, ground contacts 15, configured to press contacts to fit to from one side for electrical conduction, are formed on the leads 10-1 and 12-1 on a first side opposite to a second side on which the connector 3 is mounted on the board. The leads 10-1 and 12-1 are configured to be connected to through holes of the board as illustrated in the first embodiment and the second embodiment. In addition, the leads 10-1 and 12-1 further include respective portions to be connected to pads (connected to the board through the through holes 60-1 and 60-M, where M is an integer satisfying 0<M<N). Taking the lead 10-1 as an example, its portion to be connected to a pad through the hole 60-1 may correspond to the lead 20-1 in FIG. 9.

Further, signal contacts 25, configured to press contacts to fit to from one side for electrical conduction, are formed on the leads 20 to be connected to signal terminals of the board via pads on the first side opposite to the second side on which the connector 3 is mounted on the board.

The leads 20 are lead parts for surface mounting, which are shaped to be bent at one end. The bent portions, which are hereinafter referred to as "contact portions 27," come into contact with and are soldered to pads, so that the leads 20 are connected to the board.

After the leads 20 including the contact portions 27 pass through the corresponding holes (such as the hole 60-2) of the solder sheet 60, the solder sheet 60 is shifted a predetermined distance in the direction indicated by arrow Y in FIG. 11, so that the contact portions 27 catch the corresponding holes of the solder sheet 60 to prevent the solder sheet 60 from coming off the connector 3. Here, the direction indicated by arrow Y may be a direction substantially perpendicular to a lengthwise direction of the solder sheet 60 (indicated by arrow X in FIG. 11) in a plane (an X-Y plane in FIG. 11) parallel to a surface of the solder sheet 60 on which surface the holes 60-1 . . . 60-M are open.

Figure 12B:
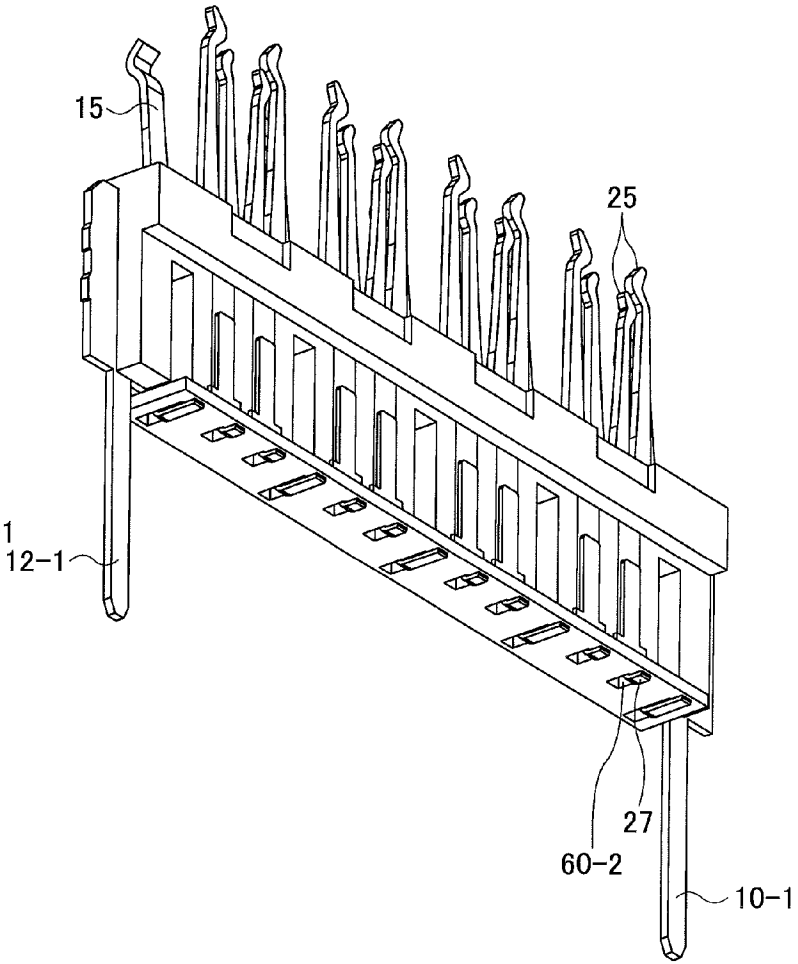
FIGS. 12A and 12B are exploded perspective views of the (partial) solder sheet engaged with and fixed to the connector taken from different directions according to the third embodiment of the present invention.
Figure 12A:
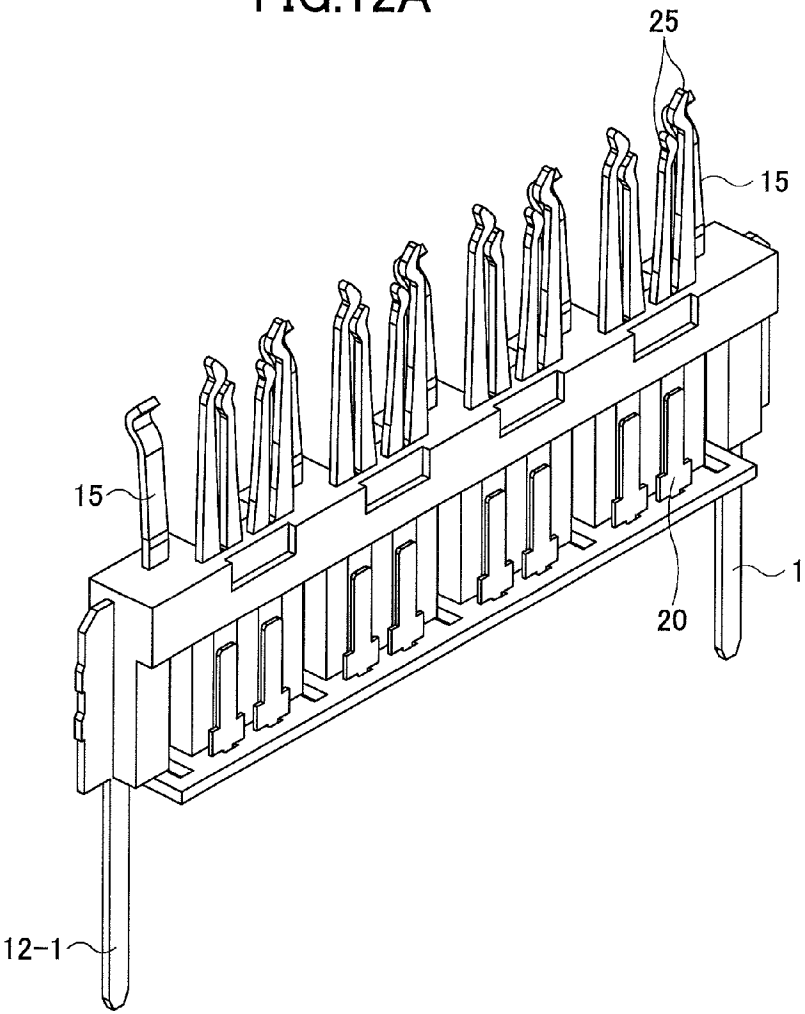

FIGS. 12A and 12B are exploded perspective views of the (partial) solder sheet 60 engaged with and fixed to the connector 3 taken from different directions.

Referring to FIGS. 12A and 12B, the position of, for example, the contact portion (bent end portion) 27 of the lead 20 and the position of the corresponding hole 60-2 in the solder sheet 60 are offset from each other relative to the direction in which the solder sheet 60 has been shifted after insertion of the lead 20 through the hole 60-2, so that the solder sheet 60 is hooked on the contact portion 27 through the hole 60-2.

A description is given below of a process for mounting the connector 3 on a board according to this embodiment.

Like in the first embodiment, the connector 3 configured as described above is mounted on a board by reflow soldering. Reference is made to FIG. 4 for the processes of reflow soldering, and a detailed description thereof is omitted.

According to the connector 3 of this embodiment, the solder sheet 40 and the solder sheet 42 (which may be replaced with the solder sheets 50 and 52, respectively, of the second embodiment) are attached in advance to the leads 10-1, 10-2, . . . 10-n and the leads 12-1, 12-2, . . . 12-n, respectively, for which amounts of solder would otherwise be likely to be insufficient at the time of connection (because of establishing connections to through holes). In the above-described reflow process, these solder sheets 40 and 42 melt to flow into corresponding through holes together with the solder paste, and fix and connect the leads 10-1, 10-2, . . . 10-n and the leads 12-1, 12-2, . . . 12-n to the corresponding through holes. Here, a single solder sheet is attached to multiple leads. The molten solder sheet is divided because of surface tension, so that an appropriate amount of solder is separately provided for each lead.

This structure allows sufficient amounts of solder to be provided to the connections of the leads 10-1, 10-2, . . . 10-n and the corresponding through holes and the connections of the leads 12-1, 12-2, . . . 12-n and the corresponding through holes, thus making it possible to improve the strength and the connection reliability. Further, this structure eliminates the necessity of adjusting the thickness of solder on an individual electrode basis, thus making it possible to reduce the operational load of soldering.

Further, according to the connector 3 of this embodiment, the solder sheet 60 is attached to the leads 20-1, 20-2, . . . 20-N to be surface-mounted on pads as well. Therefore, the applying process in reflow soldering may be omitted. Accordingly, it is possible to further reduce the operational load of soldering.

According to the above-described connector 3 and the solder sheet 60 of this embodiment, it is possible to provide a sufficient amount of solder where required and to reduce the operational load of soldering in soldering a connector to a board.

All examples and conditional language recited herein are intended for pedagogical purposes to aid the reader in understanding the invention and the concepts contributed by the inventors to furthering the art, and are to be construed as being without limitation to such specifically recited examples and conditions, nor does the organization of such examples in the specification relate to a showing of the superiority or inferiority of the invention. Although the embodiments of the present invention have been described in detail, it should be understood that various changes, substitutions, and alterations could be made hereto without departing from the spirit and scope of the invention.

For example, in the third embodiment, the connector 3 may not have the solder sheets 40 and 42 (so that the solder sheet 60 is the only solder sheet of the connector 3), and through holes may be manually provided with solder.

Further, in application of embodiments of the present invention, the degree of division of the solder sheet in attaching the solder sheet to the connector is not limited in particular, and may be suitable determined in accordance with the shape of the connector and the arrangement of leads. Further, the connector may be provided with a single solder sheet.

Embodiments of the present invention may be applied in manufacturing industries such as a connector manufacturing industry and an electronic component manufacturing industry.

What is claimed is:

1. A connector to be mounted on a board, comprising:

a plurality of lead parts configured to be electrically connected to corresponding terminals on the board; and a solder sheet for soldering the connector to the board, the solder sheet being made of solder and having a plate shape, the solder sheet having a plurality of holes formed therein, wherein the solder sheet is engaged with and fixed to the lead parts with the lead parts inserted through the corresponding holes in the solder sheet, wherein the solder of the solder sheet melts to electrically connect the lead parts to the corresponding terminals on the board, wherein at least either the lead parts or the solder sheet has a structure configured to prevent the solder sheet from coming off the lead part, wherein each of the lead parts includes a first projecting portion formed on a first surface of the lead part and a second projecting portion formed on a second surface of the lead part opposite to the first surface, and wherein the first and second projecting portions are configured to catch the corresponding holes in the solder sheet with the lead parts inserted through the corresponding holes, so that the solder sheet is prevented from coming off the lead parts.

2. A solder sheet for soldering a connector to a board, the solder sheet having a plate shape and being made of solder, wherein the solder sheet has a plurality of holes formed therein and is configured to be attached to a plurality of lead parts of the connector with the lead parts inserted through the corresponding holes in the solder sheet, wherein the solder of the solder sheet melts to electrically connect the lead parts to corresponding terminals on the board, wherein each of the holes is formed of first and second rectangular slits crossing each other at right angles to have a cruciform slit shape so that the solder sheet elastically deforms at each of the holes so as to cause each of the holes to be spread by a pressing force of the corresponding lead part inserted through each of the holes, and wherein the solder sheet engages with first and second projecting portions of each of the lead parts inserted through the holes at first and second opposite ends of the first rectangular slit of the corresponding hole, respectively, the first and second projecting portions being formed on first and second opposite surfaces of each of the lead parts, and the solder sheet holds third and fourth opposite surfaces of each of the lead parts inserted through the holes with a restoring force of the corresponding hole, the third and fourth surfaces being perpendicular to the first and second surfaces.

3. The connector as claimed in claim 1, wherein each of the holes is formed of first and second rectangular slits crossing each other at right angles to have a cruciform slit shape so that the solder sheet elastically deforms at each of the holes so as to cause each of the holes to be spread by a pressing force of the corresponding lead part inserted through each of the holes, and the solder sheet engages with the first and second projecting portions of each of the lead parts inserted through the holes at first and second opposite ends of the first rectangular slit of the corresponding hole, respectively, and the solder sheet holds third and fourth surfaces of each of the lead parts inserted through the holes with a restoring force of the corresponding hole, the third and fourth surfaces being perpendicular to the first and second surfaces, so that the solder sheet is prevented from coming off the lead parts.

4. A connector, comprising:

a plurality of lead parts configured to be electrically connected to corresponding terminals on the board; and a solder sheet for soldering the connector to the board, the solder sheet being made of solder and having a plate shape, the solder sheet having a plurality of holes formed therein, wherein the solder sheet is engaged with and fixed to the lead parts with the lead parts inserted through the corresponding holes in the solder sheet, wherein the solder of the solder sheet melts to electrically connect the lead parts to the corresponding terminals on the board, wherein at least either the lead parts or the solder sheet has a structure configured to prevent the solder sheet from coming off the lead part, wherein the lead parts include respective leads each provided with a bent end portion to be surface-mounted on the board, and wherein a position of the bent end portion and a position of the corresponding hole in the solder sheet are offset from each other relative to a direction in which the solder sheet is shifted after insertion of the lead parts through the corresponding holes so as to have the solder sheet hooked on the bent end portion through the corresponding hole.

* * * * *